US008822798B1

(12) United States Patent
Martin

(10) Patent No.: US 8,822,798 B1
(45) Date of Patent: Sep. 2, 2014

(54) CLUTCH ASSEMBLY FOR HIGH-HAT DRUM CYMBAL

(71) Applicant: Harold A. Martin, Calumet City, IL (US)

(72) Inventor: Harold A. Martin, Calumet City, IL (US)

(73) Assignee: Harold A. Martin, Calumet City, IL (US)

( * ) Notice: Subject to any disclaimer, the term of this patent is extended or adjusted under 35 U.S.C. 154(b) by 0 days.

(21) Appl. No.: 13/839,591

(22) Filed: Mar. 15, 2013

(51) Int. Cl.
*G10D 13/02* (2006.01)

(52) U.S. Cl.
USPC ..... 84/422.3

(58) Field of Classification Search
USPC ..... 84/422.1, 422.2, 422.3, 421
See application file for complete search history.

(56) References Cited

U.S. PATENT DOCUMENTS

| | | | | |
|---|---|---|---|---|
| 4,730,532 | A | 3/1988 | Bauerfeind | |
| 4,928,567 | A | 5/1990 | Kurosaki | |
| 5,028,776 | A | 7/1991 | Forti | |
| 5,415,072 | A | 5/1995 | Huang | |
| 5,438,903 | A | 8/1995 | Cropek | |
| 8,153,877 | B2 | 4/2012 | Coady | |
| 8,198,522 | B2 * | 6/2012 | Michael | 84/422.3 |
| 8,476,515 | B2 * | 7/2013 | Coady | 84/422.3 |

* cited by examiner

*Primary Examiner* — Kimberly Lockett
(74) *Attorney, Agent, or Firm* — Richard D. Harris; Greenberg Traurig, LLP

(57) ABSTRACT

A clutch assembly for a high-hat drum cymbal. A coiled spring is compressed between an upper bearing surface on an enclosure assembly and a lower bearing surface on a bearing assembly. An upper cymbal assembly is separable from the bearing assembly, and includes a first catch for cooperation with a first lever. In one embodiment, the coiled spring forces the bearing assembly and upper cymbal assembly tightly against the lower cymbal to create a distinct sound when struck by a drumstick. In another embodiment, the bearing assembly includes a second catch for cooperation with a second lever. The first lever enables the upper cymbal to fall on the lower cymbal for another type of sound. The second lever enables the spring to bias the upper cymbal tightly against the lower cymbal.

14 Claims, 6 Drawing Sheets

CLUTCH ASSEMBLY FOR HIGH-HAT DRUM CYMBAL

BACKGROUND

Field of the Invention

The present invention relates generally to a high-hat drum cymbal, and particularly to a clutch assembly for a high-hat drum cymbal. High-hat drum cymbals are known to include a rod, a foot pedal, a lower cymbal and an upper cymbal aligned with the lower cymbal. High-hat drum cymbals are typically maintained in an original position, in which the lower and upper cymbals are separated from one another. Upon activation by a drummer, the two cymbals can be brought into contact with each other using the foot pedal to create a sound upon impact ("Sound One"), or maintained in contact by the foot pedal and struck by a drummer's drumstick for a variation in cymbal sound ("Sound Two"). The present invention is capable of moving the high-hat drum cymbal from its original position to one or more distinct cymbal engagement positions, to create additional varying cymbal sounds when the upper cymbal is struck by a drummer.

In a conventional high-hat drum cymbal, the up-and-down motion of the upper cymbal is controlled by a foot pedal, which allows the high-hat drum cymbal to be moved into one or more cymbal engagement positions. For example, in one cymbal engagement position, the foot pedal is depressed to bring the upper cymbal into contact with the lower cymbal with substantial pressure so that the contact of the upper and lower cymbals prevents substantial vibration therebetween. As a result, when struck, the high-hat drum cymbal creates a "tight" noise resembling the hard consonant sound of the letter "T" (Sound Two). In a different cymbal engagement position, the foot pedal is depressed with just a light force to merely bring the upper cymbal into contact with the lower cymbal (as if the weight of the upper cymbal merely rested on the lower cymbal). In such a position, the adjacent cymbals do not substantially prevent each other's vibration, resulting in a distinct, "crashier" ("TSSS") sound ("Sound Three")

Clutch assemblies for high-hat drum cymbals have been used in the past, as shown in U.S. Pat. Nos. 4,928,567 and 5,415,072. The '567 patent describes a clutch in which a lever can be activated, allowing the upper cymbal to fall on the lower cymbal. When a drummer strikes the upper cymbal in that position, it results in Sound Three. The '072 patent describes a "foot-pedal engaging mechanism," in which a spring above the upper cymbal allows a drummer to tightly engage the upper and lower cymbals to create Sound Two, again, without needing to depress the foot pedal. Such clutches are useful because they free up a drummer's foot, which can be used for other purposes, such as activating a double pedal for the bass drum.

However, neither of those patents disclose a mechanism whereby a drummer can produce, and adjust, both Sound Two and Sound Three, without depressing the foot pedal. As a result of the present invention's structure and operation, the present invention thus provides additional functionality not present in the prior art, namely, the ability to move the high-hat drum cymbal into multiple cymbal engagement positions—for a myriad of different cymbal sounds in an environment in which the degree of bias force on the cymbals can be adjusted.

SUMMARY OF THE INVENTION

A clutch assembly for a high-hat drum cymbal includes an enclosure assembly, a bearing assembly and an upper cymbal assembly. The enclosure assembly comprises a housing with an upper bearing surface at its upper end, against which one end of a coiled spring bears, and an exterior surface opposite the upper bearing surface. The bearing assembly comprises a bearing plate with a lower bearing surface against which the other end of the coiled spring bears, and an upper bracket emanating upwardly from the bearing plate. The upper cymbal assembly, which is separable from said bearing assembly, includes the upper cymbal of the high-hat drum cymbal and an upper cymbal collar positioned above and restrainably attached to the upper cymbal. The upper cymbal collar includes a first catch for alignment, and restorably releasable engagement, with a first release lever.

In one preferred embodiment, the first release lever cooperates with the first catch to release the first catch, thereby allowing the force of the coiled spring to move the high-hat drum cymbal into a spring-biased engagement position, in which both the bearing assembly and the upper cymbal assembly are spring-biased, pushing the upper cymbal against the lower cymbal. The first release lever also operates to re-engage the first catch upon depression of the foot pedal and rod by the drummer, to retain both the upper and lower cymbals in the original position.

In another preferred embodiment, the bearing assembly includes a second catch for alignment, and restorably releasable engagement, with a second release lever, in which the second release lever and second catch can release and re-engage the spring-biased force of the coiled spring. In this embodiment, when the first release lever releases the first catch, the weight of the upper cymbal assembly causes it to fall, to place the high-hat drum cymbal into a deadweight engagement position—in which the upper cymbal rests on the lower cymbal. Alternatively, in this embodiment, if desired, while the first catch and release are still in their engaged (locked) position, the second release lever can be activated to release the second catch, thereby allowing the coiled spring to force the bearing assembly into a juxtaposed, biased orientation against the upper cymbal assembly. Since the first catch remains engaged (locked) by the first release lever, both the upper and lower cymbals are maintained in their original position. Alternatively, this embodiment also allows both of the first and second catches to be subsequently released by disengaging the first catch and first release lever hold, thereby allowing the force of the coiled spring and the weight of the upper cymbal assembly to bring the high-hat drum cymbal into its spring-biased engagement position, in which the upper cymbal is spring (and weight) biased against the lower cymbal. The second release lever can also re-engage the second catch to enable the upper and lower cymbals to be repositioned to their original position, upon depressing of the foot pedal and rod by the drummer. The first release lever can also re-engage the first catch to retain both the upper and lower cymbals in their original position upon foot pedal depression—to lower the rod until the release lever holds snap back to engage their respective catches.

In another preferred embodiment, the first release lever is a spring-loaded deadweight lever for release from the first catch, and the second release lever is a spring-loaded biasing lever for release from the second catch. In this embodiment, the spring-loaded biasing lever simultaneously activates the spring-loaded deadweight lever to simultaneously release both the first and second catches when the spring-loaded biasing lever is activated. In either of the preferred embodiments, the upper cymbal assembly further comprises a sound-deadening cushion positioned between the upper cymbal and the upper cymbal collar.

In still another preferred embodiment of the invention, the bearing assembly further includes a downward-facing projection or piston, sized to fit within, and be telescopically received by, the upper cymbal collar. In yet a further refined version of this preferred embodiment, the upper cymbal collar includes a vertical keyway, and the projection comprises a key for alignment with and reciprocation within the vertical keyway, thereby preventing the rotation of the bearing assembly relative to the upper cymbal collar as the projection telescopically translates within the upper cymbal assembly.

In the preferred embodiment of the invention, the enclosure assembly also comprises a rod collar for attaching the housing to the rod. In one example of this preferred embodiment, the rod collar is restrainably attached to the rod through a set screw, which prevents rotation and/or longitudinal movement of the enclosure assembly about the rod. In still another preferred version of this embodiment, an interior portion of the rod collar and a portion of the exterior surface of the housing are each threaded and aligned, such that the housing can move longitudinally toward and away from the rod collar and along the rod, when the housing is rotated. As a result of the threaded engagement, the tension force of the coiled spring is adjustable, inasmuch as rotating the housing about the rod moves the housing upward or downward about the rod, thereby expanding or compressing the coiled spring.

In all of the preferred embodiments, the first release lever re-engages the first catch when the foot pedal is depressed. Additionally, the second release lever can also re-engage the second catch with the foot pedal is depressed, such that both release levers can re-engage their respective catches when the foot pedal is depressed.

In a further preferred embodiment, the second catch is affixed to the bearing assembly at a position along the upper bracket.

In yet another preferred embodiment, the first release lever and second release lever each have different lengths to facilitate the independent activation of those levers by a drummer's drumstick.

DETAILED DESCRIPTION

Reference will now be made in detail to the preferred embodiments of the invention, examples of which are illustrated in the accompanying drawings. While the invention will be described in conjunction with the preferred embodiments, the invention is intended to cover any and all alternatives, modifications and equivalents, which may be included within the spirit and scope of the invention, as defined by the claims. Furthermore, in the detailed description of the present invention, several specific details are set forth in order to provide a thorough understanding of the present invention. However, one of ordinary skill in the art would appreciate that the present invention may be practiced without all of these specific details. Thus, while the invention is susceptible to embodiment in many different forms, the subsequent description of the present disclosure should be considered only as an exemplification of the principles of the invention, one that is in no way intended to limit the invention to the embodiments so illustrated.

Figure 1:
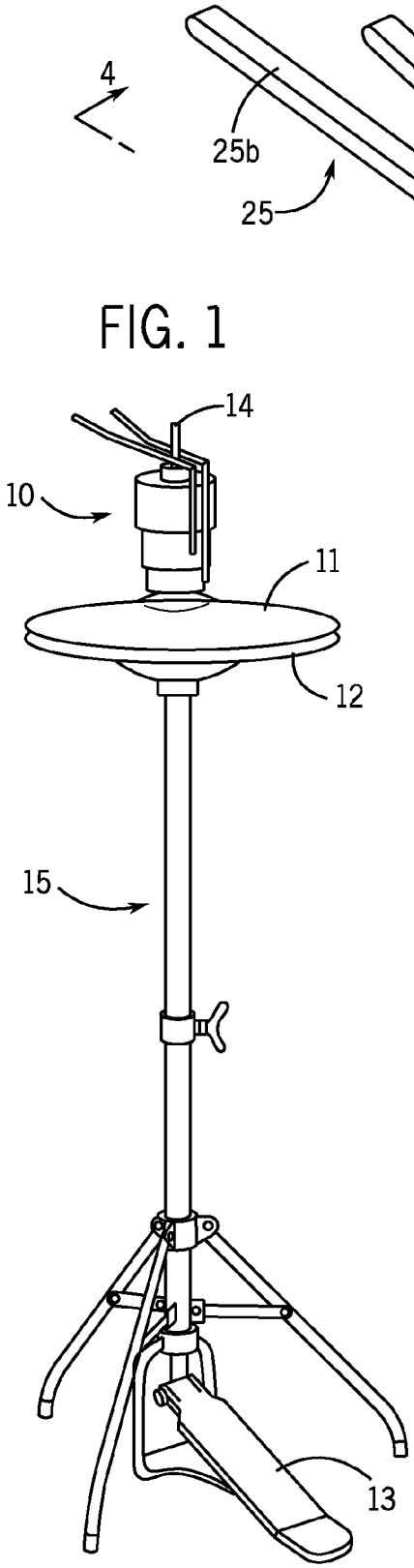
FIG. 1 is a front perspective view of a complete high-hat drum cymbal fitted with the clutch assembly of the present invention.

FIG. 1 shows a conventional high-hat drum cymbal 15, fitted with a clutch assembly 10 according to the present invention. High-hat drum cymbal 15 includes upper cymbal 11 and lower cymbal 12, the latter being stationary, and the former being attached to rod 14, which is inserted through the center of upper cymbal 11 and lower cymbal 12. High-hat drum cymbal 15 also includes foot pedal 13. Depressing foot pedal 13 causes rod 14 and upper cymbal 11 to move downwardly together, to place upper cymbal 11 in contact with lower cymbal 12.

Figure 2:
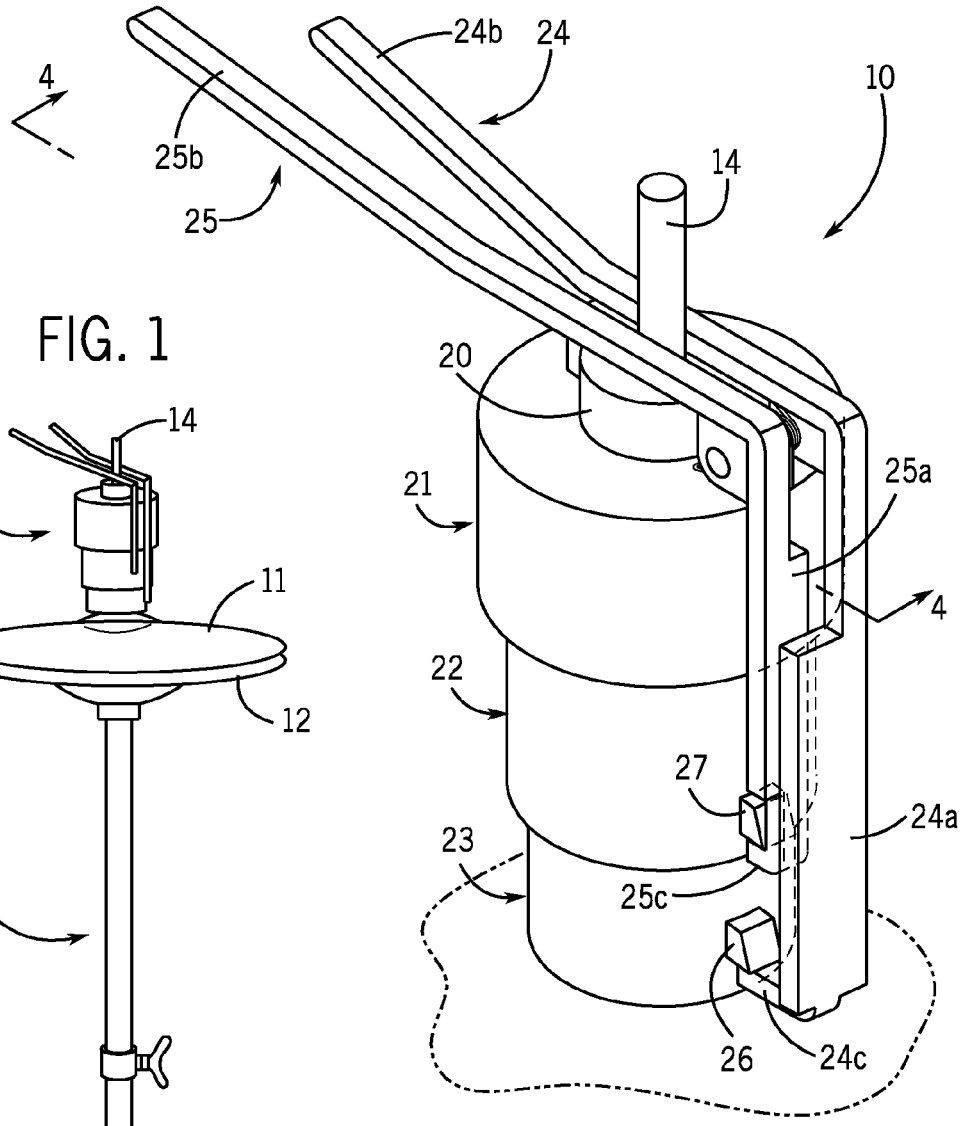
FIG. 2 is a top perspective view of the clutch assembly of the present invention, showing particular detail about the enclosure assembly, the bearing assembly and the upper cymbal assembly, and the first and second release levers.

Clutch assembly 10 of the present invention is also shown in FIG. 2, mounted on rod 14. Clutch assembly 10 comprises enclosure assembly 21, bearing assembly 22 and upper cymbal assembly 23, each of which will be discussed in further detail hereinbelow. Clutch assembly 10 further comprises rod collar 20, which is restrainably attached to rod 14. In addition, clutch assembly comprises first release lever 24, which itself comprises first end 24*a* and second end 24*b*, wherein second end 24*b* includes first hold 24*c* for engaging first catch 26. In one preferred embodiment, clutch assembly 10 also includes second release lever 25, which itself comprises first end 25*a* and second end 25*b*, wherein second end 25*b* includes second hold 25*c* for engaging second catch 27. Rod 14 is affixed to clutch assembly 10 at rod collar 20.

Figure 3:
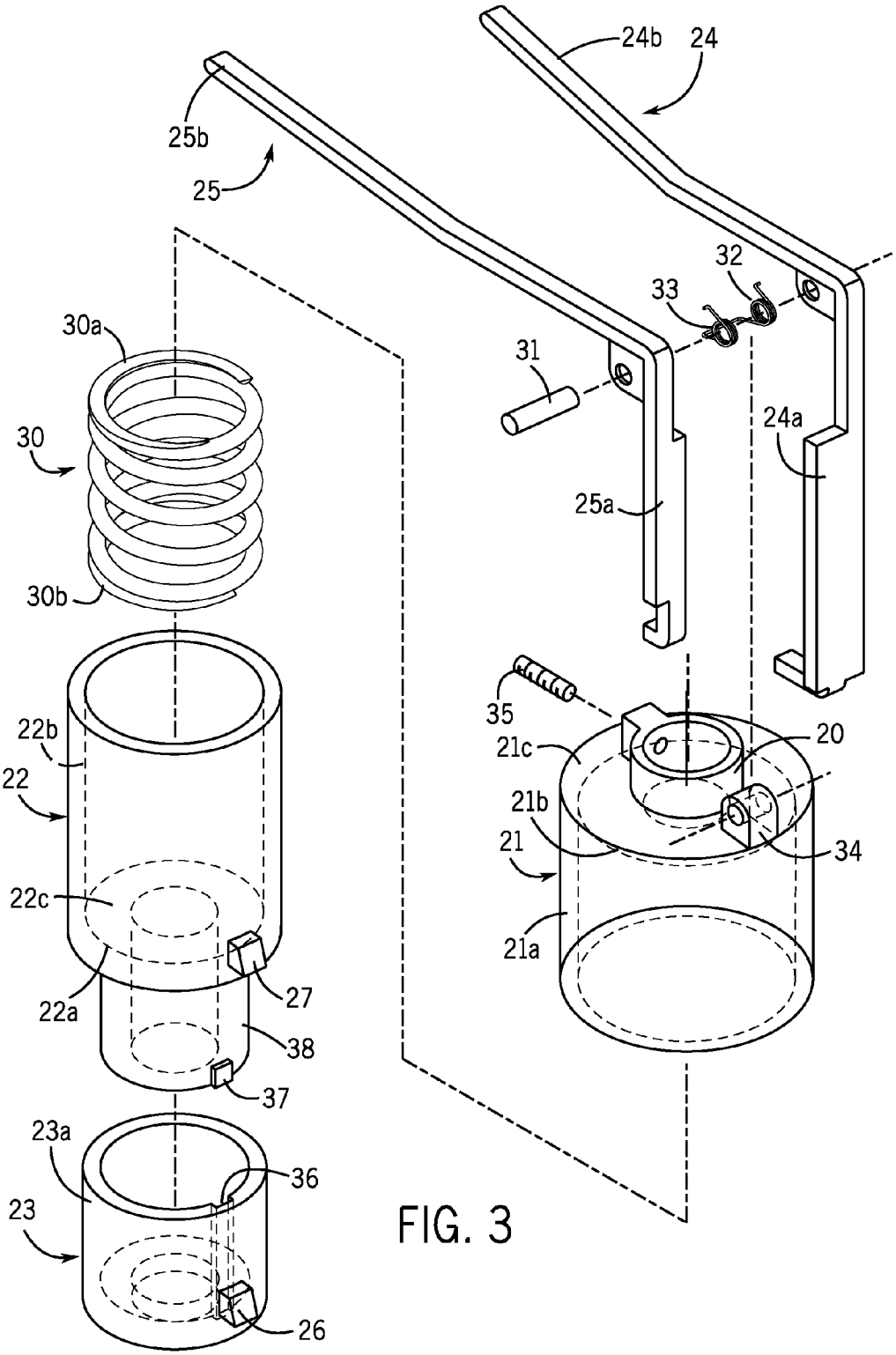
FIG. 3 is an exploded perspective view of a preferred embodiment of the clutch assembly of the present invention showing the levers positioned on the top of the enclosure assembly, the coiled spring fitting into the bearing assembly, and the bearing assembly fitting into the upper cymbal collar.

The exploded view of FIG. 3 shows a preferred embodiment of clutch assembly 10, in which enclosure assembly 21 comprises housing 21*a* with exterior surface 21*c*, to which rod collar 20 is attached. Housing 21*a* also includes upper bearing surface 21*b*, and hinge 34. First release lever 24 and second release lever 25 are mounted to enclosure assembly 21 with pin 31. Pin 31 is inserted through first release lever 24, first lever spring 32 and hinge 34, and then through second lever spring 33 and finally through second release lever 25. In this way, pin 31 cooperates with hinge 34 and each of said first and second release levers 24, 25 to attach the levers to enclosure assembly 21 for independent activation of one or both of first and second release levers 24 and 25, either simultaneously or in succession. First and second lever springs 32 and 33 enable first and second release levers 24 and 25, respectively, to move vertical portions 24*a* and 25*a* of first and second release levers 24 and 25 when horizontal ends 24*b* and 25*b* are struck by a drummer's drumstick (not shown). Set screw 35 is threaded to engage rod collar 20 to, in turn, restrainably attach rod collar 20 to rod 14 (not shown in FIG. 3).

Bearing assembly 22 comprises bearing plate 22*a*, upper bracket 22*b* and lower bearing surface 22*c* at the top of bearing plate 22*a*. Coiled spring 30 has first end 30*a* and second end 30*b*, and fits within (and between) both housing 21*a* and bearing assembly 22. First end 30*a* bears on upper bearing surface 21*b*, which is located at the upper internal end of housing 21*a*. Second end 30*b* bears on lower bearing surface 22*c* on the top of bearing plate 22*a*, located at the lower internal end of bearing assembly 22. In one embodiment, bearing assembly 22 comprises projection 38, which is sized to fit within, and be telescopically received by, upper cymbal collar 23*a*. Upper cymbal assembly 23 includes first catch 26 and, in a preferred embodiment, bearing assembly 22 includes second catch 27. Bearing assembly 22 also includes key 37 for alignment with and reciprocation within vertical keyway 36.

Figure 4:
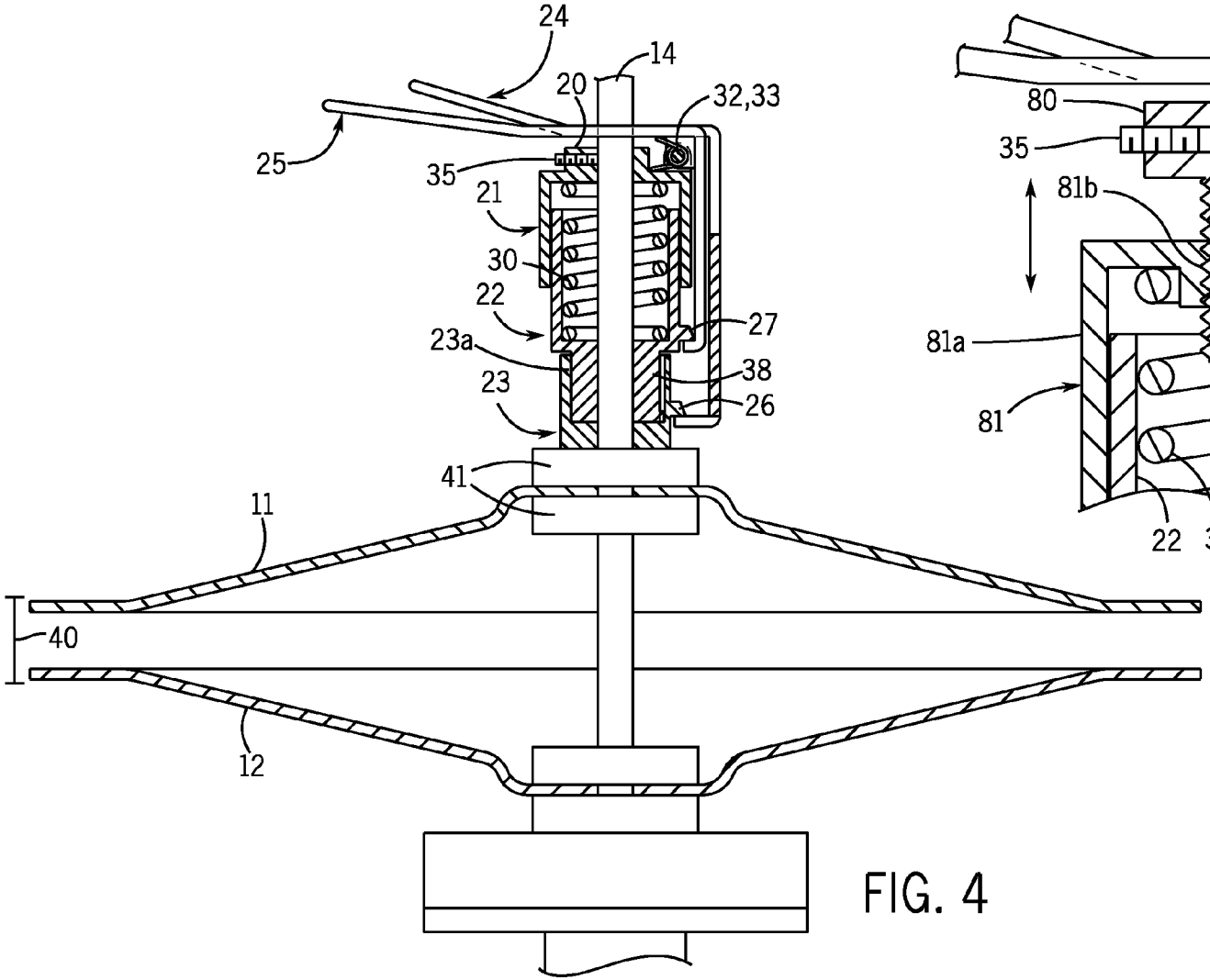
FIG. 4 is an elevated cross-sectional view of one embodiment of the clutch assembly of the present invention, taken along lines 4-4 of FIG. 2 and looking in the direction of the arrows, in which the high-hat drum cymbal is shown in its original (separated cymbal) position.

As shown in FIG. 4, clutch assembly 10 is attached to upper cymbal 11, through upper cymbal assembly 23, and high-hat drum cymbal 15 (FIG. 1) is in its original position when upper cymbal 11 and lower cymbal 12 are separated at gap 40. Upper cymbal 11 is attached to upper cymbal collar 23*a* preferably through sound-deadening cushion portions 41 interposed therebetween. One portion of cushion 41 is attached above upper cymbal 11, while an additional sound-deadening cushion portion 41 is attached below upper cymbal 11. Projection 38 of bearing assembly 30 is enclosed within upper cymbal collar 23*a* when high-hat drum cymbal 15 is in its original position, in which upper cymbal 11 and lower cymbal 12 are separated at gap 40.

Figure 5:
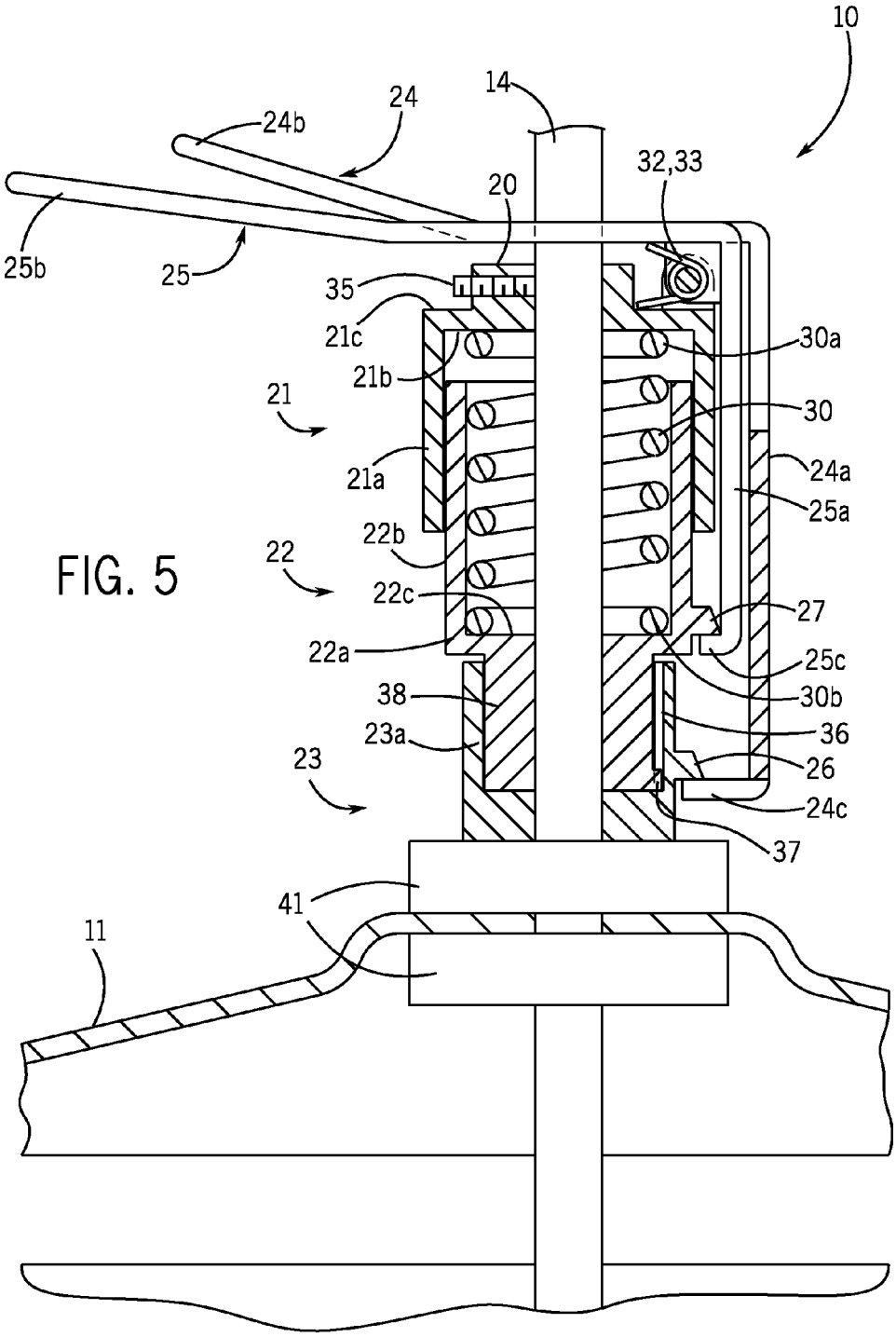
FIG. 5 is a cross-sectional view of the clutch assembly of the present invention according to FIG. 4, in which each of the first and second release levers are shown being engaged with the first and second catches, respectively, to maintain the high-hat drum cymbal in its original position.

FIG. 5 shows rod collar 20 as restrainably attached to rod 14 by set screw 35. In this original position, coiled spring 30 is compressed between lower bearing surface 22*c* of bearing assembly 22 and upper bearing surface 21*a* of enclosure assembly 21. With each of said first and second release levers 24 and 25 engaging their first and second catches 26 and 27, respectively, coiled spring 30 is compressed between upper bearing surface 21*b* of housing 21*a* and lower bearing surface 22*c* of bearing plate 22*a*, and projection 38 of bearing assembly 22 remains received within upper cymbal collar 23*a*. Upper cymbal 11 is thus maintained above and separated from lower cymbal 12 at gap 40 (FIG. 4) to retain high-hat drum cymbal 15 in its original position 40.

Figure 6:
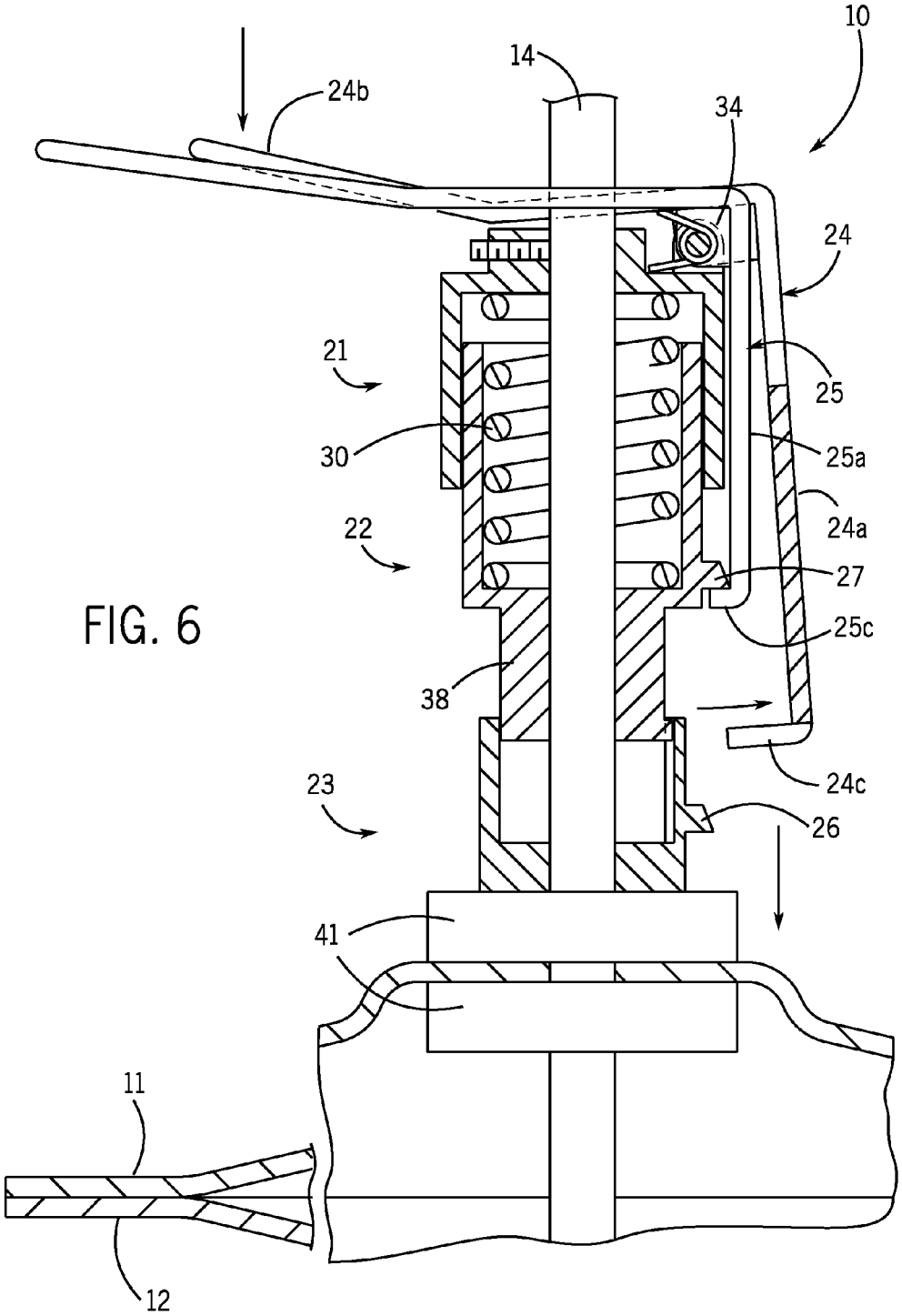
FIG. 6 is a cross-sectional view of the clutch assembly of the present invention according to FIG. 5, in which the first hold of the first release lever is shown released from the first catch, while the second release lever is shown engaged with the second catch, to orient the high-hat drum cymbal in its deadweight engagement position.

Clutch assembly 10 is shown in FIG. 6 with high-hat drum cymbal 15 in its deadweight engagement position, in which the weight of upper cymbal assembly 23 causes upper cymbal assembly 23 to fall and rest, without spring-biased force, on lower cymbal 12, as described hereinbelow. First release lever 24 has been activated by a drumstick or other device (not shown) striking horizontal end 24*b*. As a result, vertical portion 24*a* is pivoted at hinge 34 (FIG. 3) to retract hold 24*c* from engagement with first catch 26. Thus, upper cymbal assembly 23—including upper cymbal 11, sound-deadening cushions 40 and upper cymbal collar 23*a*—falls under its own weight, such that upper cymbal 11 and lower cymbal 12 are juxtaposed together. In this position, upper cymbal 11 and lower cymbal 12 create Sound Three when struck by a drumstick.

Figure 7:
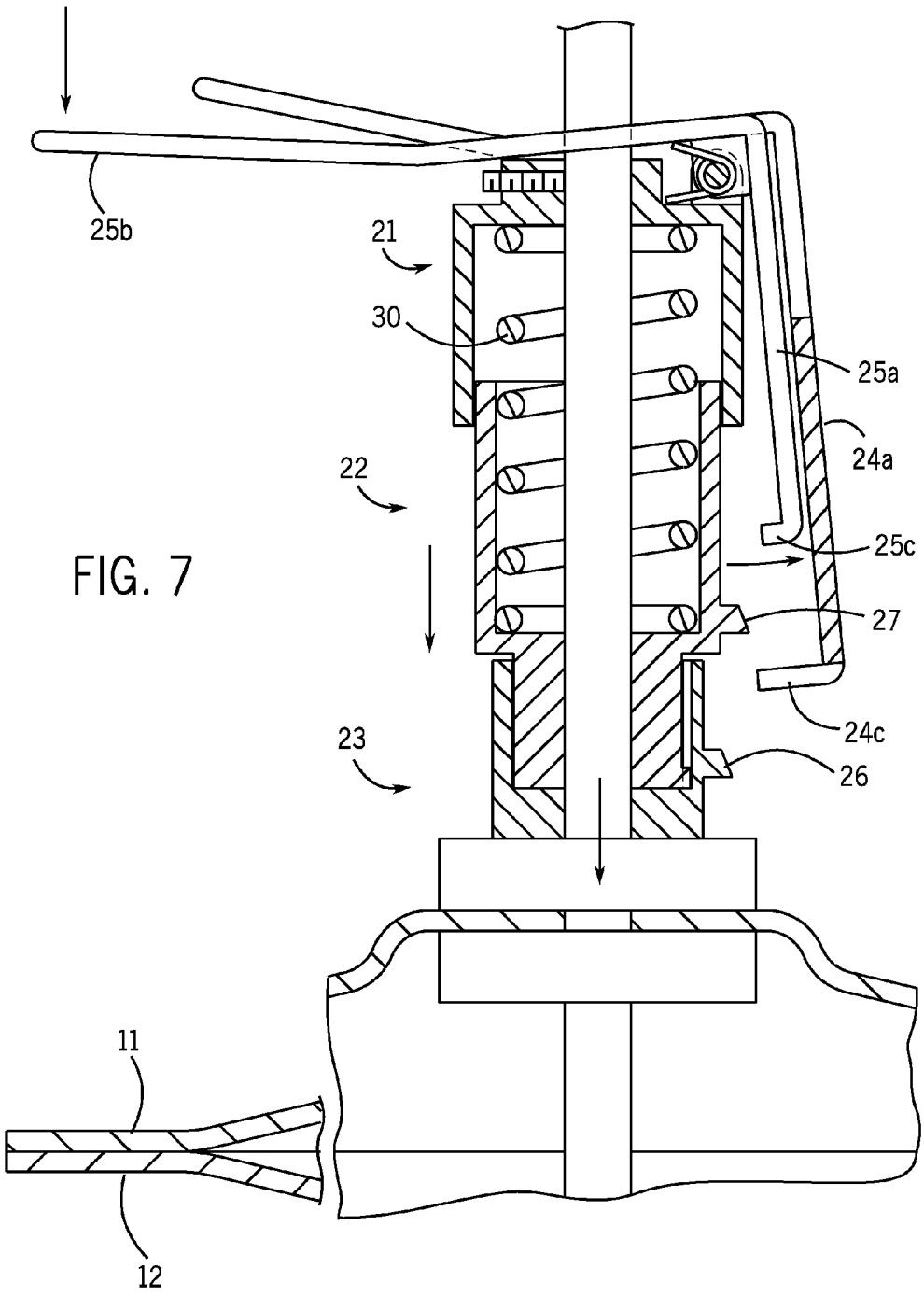
FIG. 7 is a cross-sectional view of the clutch assembly of the present invention according to FIG. 6, in which each of the first and second release lever holds are shown released from the first and second catches, respectively, to orient the high-hat drum cymbal in its spring-biased engagement position.

FIG. 7 shows clutch assembly 10 with high-hat drum cymbal in its spring-biased engagement position, in which coiled spring 30 has expanded and forced bearing assembly 22 and upper cymbal assembly 23 downward against lower cymbal 12, as described hereinbelow. Second release lever 25 has been activated by a drumstick or other device (not shown) striking horizontal end 25*b*, thereby releasing second catch 27 As a result, second hold 25*c* retracts from catch 27, releasing catch 27 and bearing assembly 22. In FIG. 7, second release lever 25 simultaneously activates first release lever 24 to retract hold 24*c* from catch 26 in upper cymbal assembly 23, thereby also releasing first catch 26 and bearing assembly 22. As a result, coiled spring 30 expands and pushes both bearing assembly 22 and upper cymbal collar 23 downwardly upon upper cymbal 11 to, in turn, push upper cymbal 11 downwardly against lower cymbal 12. In this position, upper cymbal 11 and lower cymbal 12 create Sound Two when struck by a drumstick. However, as discussed below in the context of FIG. 8, Sound Two can itself have varying degrees of noises depending on how much adjustable, spring-biased pressure is exerted downwardly on upper cymbal 11.

While FIG. 7 shows second release lever 25 simultaneously activating first release lever 24, first and second release levers 24 and 25 can also be made to operate completely independently from one another upon removal of the overlap of vertical portion 24*a* of first release lever 24 over vertical portion 25*b* of second release lever. When first and second release levers 24 and 25 operate independently of each other, the activation of just second release lever 25 causes second release lever 25 to release second catch 27, thereby allowing coiled spring 30 to expand to push bearing assembly 22 downward against upper cymbal collar 23. Then, once first release lever 24 is activated, first release lever 24 releases catch 26 to allow coiled spring 30 to expand further, pushing both bearing assembly 22 and upper cymbal collar 23*a* downwardly upon upper cymbal 11 to, in turn, push upper cymbal 11 downward against lower cymbal 12.

Figure 8:
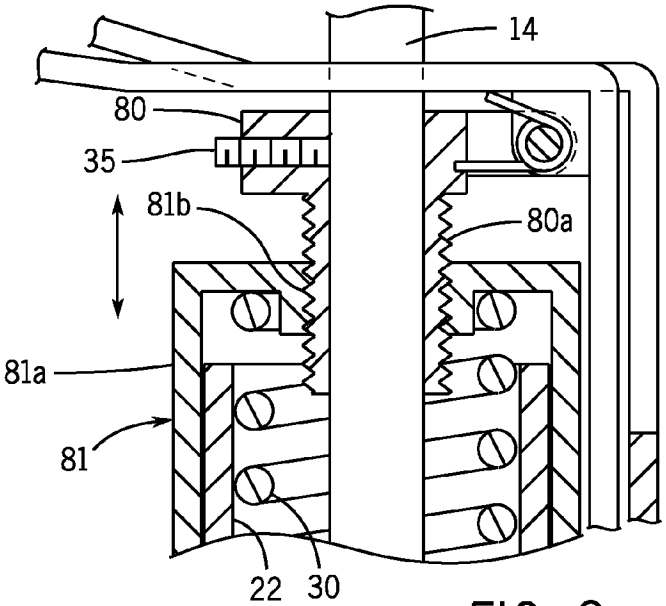
FIG. 8 is an enlarged elevated view of the enclosure assembly, showing the structure for threaded engagement between the rod collar and the housing, to enable adjustments of the spring-bias tension.

As shown in FIG. 8, rod collar 80 may include a threaded portion 80*a* extending downwardly, which is adapted to be received within housing 81*a*. Housing 81*a* further includes threaded interior circumference 81*d* to receive and cooperate with threaded portion 80*a* of rod collar 80. By rotating housing 81*a* about rod 14, upper bearing surface 81*b* and can adjust the compressed length of coiled spring 30, thereby enabling adjustments to the tension of coiled spring 30.

The foregoing description and drawings merely explain and illustrate the invention, and the invention is not so limited as those skilled in the art who have the disclosure before them will be able to make modifications and variations therein without departing from the scope of the invention.

What is claimed is:

1. A clutch assembly for a high-hat drum cymbal, said high-hat drum cymbal including a rod, a foot pedal, a lower cymbal and an upper cymbal aligned with said lower cymbal, said high-hat drum cymbal defining an original position, in which the lower and upper cymbals are separated from one another, and at least one cymbal engagement position in which the lower and upper cymbals are in contact with each other, to create varying cymbal sounds when struck by a drummer, said clutch assembly comprising:

an enclosure assembly attached to said rod, said enclosure assembly comprising a housing having an upper bearing surface at the upper interior end thereof, and an exterior surface opposite said upper bearing surface, said enclosure assembly further including a coiled spring having a first side adjacent said upper bearing surface and a second side opposite said first side;

a bearing assembly comprising a bearing plate having a lower bearing surface adjacent said second side of said coiled spring, and an upper bracket emanating upwardly from said bearing plate; and an upper cymbal assembly separable from said bearing assembly, said upper cymbal assembly comprising an upper cymbal collar positioned above and restrainably attached to said upper cymbal, said upper cymbal collar including a first catch affixed thereto for alignment, and restorably releasable engagement, with a first release lever;

said first release lever cooperating with said first catch to alternatively release said first catch, thereby allowing said high-hat drum cymbal to move from its original position to a spring-biased, engagement position, wherein said coiled spring forces both said bearing assembly and said upper cymbal assembly into a juxtaposed, biased orientation against said lower cymbal, and to re-engage said first release lever with said first catch to retain both the upper and lower cymbals in said original position.

2. The clutch assembly according to claim 1, in which said bearing assembly includes a second catch affixed thereto for alignment, and restorably releasable engagement, with a second release lever, which second catch and second release lever serve to alternatively release and re-engage the spring-biased force of said coiled spring, wherein said first and second release levers cooperate with said first and second catches, respectively, to release said first catch, when said second catch is engaged by said second release lever, thereby allowing said high-hat drum cymbal to move from its original position to a deadweight engagement position, wherein said upper cymbal assembly falls into juxtaposition with said lower cymbal, and alternatively release said second catch, when said first catch is engaged by said first release lever, thereby allowing said coiled spring to force said bearing assembly into a juxtaposed, biased orientation against said upper cymbal assembly while both the upper and lower cymbals are retained in said original position, and alternatively release each of said first and second catches, respectively, thereby allowing said high-hat drum cymbal to move from said original position to said spring-biased, engagement position, wherein said coiled spring forces both said bearing assembly and said upper cymbal assembly into a juxtaposed, biased orientation against said lower cymbal, said second release lever being re-engageable with said second catch to enable repositioning of the upper and lower cymbals to said original position, said first release lever being re-engageable with said first catch to retain both the upper and lower cymbals in said original position.

3. The clutch assembly according to claim 2, in which said first release lever is a spring-loaded deadweight lever for release from said first catch and said second release lever is a spring-loaded biasing lever for release from said second catch.

4. The clutch assembly according to claim 3, in which said spring-loaded biasing lever simultaneously activates said spring-loaded deadweight lever to release both said first catch and said second catch, upon activation of the release of said spring-loaded biasing lever.

5. The clutch assembly according to claim 1, in which a sound deadening cushion is interposed between said upper cymbal and said upper cymbal collar.

6. The clutch assembly according to claim 2, in which said bearing assembly further comprises a projection emanating downwardly from said bearing plate, said projection being sized to fit within, and telescopically received by, said upper cymbal collar.

7. The clutch assembly according to claim 6, in which said upper cymbal collar includes an internal vertical keyway, said projection in said bearing assembly including a key for alignment with, and reciprocation within, said vertical keyway, so as to prevent rotation of said bearing assembly relative to said upper cymbal collar, as said projection telescopically translates within relative to said upper cymbal assembly.

8. The clutch assembly according to claim 1, in which said enclosure assembly further comprises a rod collar for attaching said housing of said enclosure assembly to said rod, said rod collar being affixed to the exterior surface of said housing, said rod collar having an interior portion and an exterior portion.

9. The clutch assembly according to claim 8, in which said rod collar is restrainably attached to said rod through a set screw so as to prevent at least one of rotation and longitudinal movement of said enclosure assembly about said rod.

10. The clutch assembly according to claim 9, in which said interior portion of said rod collar and a portion of said exterior surface of said housing are each threaded, respectively, for threaded cooperation therebetween, thereby enabling said housing to be repositioned longitudinally along said rod when said housing is rotated about said rod to, in turn, enable adjustments to the tension of said coiled spring.

11. The clutch assembly according to claim 1, in which said first release lever re-engages said first catch when said foot pedal is depressed to, in turn, lower the upper cymbal towards the lower cymbal independent of the clutch assembly.

12. The clutch assembly according to claim 2, in which said first release lever re-engages said first catch and said second release lever re-engages said second catch when said foot pedal is depressed to, in turn, lower the upper cymbal towards the lower cymbal.

13. The clutch assembly according to claim 2, in which said second catch is affixed to said bearing assembly at a position along said upper bracket.

14. The clutch assembly according to claim 2, in which said first release lever has a first length and said second release lever has a second length, wherein said first and second lengths are different to facilitate the independent activation of each of said first and second release levers by a drummer's drumstick.

* * * * *